US011456125B2

(12) United States Patent
Lind et al.

(10) Patent No.: US 11,456,125 B2
(45) Date of Patent: Sep. 27, 2022

(54) CIRCUIT BREAKER LOCKOUT APPARATUS

(71) Applicant: ABUS August Bremicker Söhne KG, Wetter-Volmarstein (DE)

(72) Inventors: Thomas Lind, Freudenberg (DE); Manuel Cornelius Neveling, Wetter (DE); Tobias Weiß, Schwerte (DE)

(73) Assignee: ABUS August Bremicker Söhne KG, Wetter-Volmarstein (DE)

( * ) Notice: Subject to any disclaimer, the term of this patent is extended or adjusted under 35 U.S.C. 154(b) by 0 days.

(21) Appl. No.: 17/069,343

(22) Filed: Oct. 13, 2020

(65) Prior Publication Data

US 2021/0110982 A1 Apr. 15, 2021

(30) Foreign Application Priority Data

Oct. 14, 2019 (DE) ..... 102019127618.7

(51) Int. Cl.
*H01H 9/20* (2006.01)
*H01H 71/02* (2006.01)
*H01H 71/50* (2006.01)

(52) U.S. Cl.
CPC ..... *H01H 9/20* (2013.01); *H01H 71/025* (2013.01); *H01H 71/50* (2013.01)

(58) Field of Classification Search
CPC ..... H01H 9/20; H01H 9/28; H01H 9/287; H01H 9/283; H01H 9/286; H01H 71/025; H01H 71/12; H01H 71/1054; H01H 71/52; H01H 71/50
USPC ..... 200/50.01, 43.15, 43.16, 43.22, 512
See application file for complete search history.

(56) References Cited

U.S. PATENT DOCUMENTS

| | | | | |
|---|---|---|---|---|
| 4,677,261 | A | 6/1987 | Nourry | |
| 5,310,969 | A * | 5/1994 | Turek | H01H 9/283 200/43.14 |
| 6,365,851 | B1 * | 4/2002 | Gasper | H01H 9/08 200/43.14 |
| 6,649,851 | B1 * | 11/2003 | Hennel | H01H 9/283 200/43.13 |
| 7,355,132 | B1 * | 4/2008 | Rezac | H01H 9/223 200/43.14 |
| 8,629,359 | B2 * | 1/2014 | Hackett | H01H 9/283 200/43.14 |

(Continued)

FOREIGN PATENT DOCUMENTS

| | | | |
|---|---|---|---|
| DE | 19917859 | A1 | 10/2000 |
| DE | 102008028049 | B3 | 8/2009 |
| GB | 2486870 | A | 5/2010 |

*Primary Examiner* — William A Bolton
(74) *Attorney, Agent, or Firm* — Dinsmore & Shohl LLP

(57) ABSTRACT

A circuit breaker lockout apparatus, in particular to a motor circuit breaker lockout apparatus, includes two half-shell like housing parts, in particular housing halves, and an adjustment element. The two housing parts are assembled to form a housing shell having a rear wall and that are connected to one another via a pivot joint that defines a pivot axis about which the two housing parts are pivotable relative to one another between a release position and a clamping position. The adjustment element is adjustable between a base position and a locked position and that is in particular rotatable about an axis of rotation in order to transfer the two housing parts from the release position to the clamping position.

20 Claims, 7 Drawing Sheets

(56) References Cited

U.S. PATENT DOCUMENTS

| | | | | |
|---|---|---|---|---|
| 8,796,568 | B2 * | 8/2014 | Mrowiec | H01H 9/282 200/50.01 |
| 8,899,636 | B2 * | 12/2014 | Fitzgerald | E05B 15/0053 292/251.5 |
| 2013/0037393 | A1 | 2/2013 | Howard | |
| 2013/0270076 | A1 | 10/2013 | Linden | |
| 2014/0165384 | A1 * | 6/2014 | Dudgeon | H01H 9/283 29/622 |
| 2019/0221380 | A1 * | 7/2019 | Enger | H01H 9/283 |

* cited by examiner

CIRCUIT BREAKER LOCKOUT APPARATUS

CROSS-REFERENCE TO RELATED APPLICATIONS

The present disclosure claims priority to German Patent Application No. 102019127618.7 filed Oct. 14, 2019, the contents of which are incorporated by reference herein.

TECHNICAL FIELD

The present disclosure relates to a circuit breaker lockout apparatus, in particular to a motor circuit breaker lockout apparatus.

BACKGROUND

Motor circuit breakers are provided to protect electric motors against overload, failure of external conductors and/or short circuits so that damage to, in particular an overheating of, the respective protected equipment can be prevented. They also serve to switch the motor on and off in the case of maintenance. A motor circuit breaker has a rotary button or a push button as a handle by which the motor circuit breaker can be switched on and off manually, i.e. by hand. After a triggering, a manual switching back on of the motor circuit breaker is necessary. However, a motor circuit breaker should generally only be switched on again when the cause of its switching off is known and eliminated. Otherwise, a switching back on can result in damage to property and/or personal injury.

It is therefore the underlying object of the present disclosure to provide a circuit breaker lockout apparatus by which the handle of a circuit breaker, in particular the handle of a motor circuit breaker, for example in case of maintenance, can be secured against a switching back on by unauthorized third parties.

SUMMARY

This object is satisfied by a circuit breaker lockout apparatus having the features of the present disclosure, and in particular by a circuit breaker lockout apparatus, in particular a motor circuit breaker lockout apparatus, comprising two half-shell like housing parts, in particular housing halves, that are assembled to form a housing shell having a rear wall and that are connected to one another via a pivot joint that defines a pivot axis about which the two housing parts are pivotable relative to one another between a release position and a clamping position, in particular to a limited extent, in particular to a limited extent in both directions. The circuit breaker lockout apparatus further comprises an adjustment element that is adjustable between a base position and a locked position, in particular to a limited extent, in particular to a limited extent in the direction of the locked position, and that is in particular rotatable about an axis of rotation in order to transfer the two housing parts from the release position into the clamping position.

The housing shell comprises two housing parts that are connected to one another via a pivot joint so that the housing shell can adopt a release position and a clamping position. In the release position, the housing shell can be placed onto a housing of a motor circuit breaker to cover the handle of a motor circuit breaker. The housing shell can subsequently be transferred in the direction of the clamping position by a pivoting of the two housing parts relative to one another and can thus be clamped to the housing of the motor circuit breaker. The pivoting of the two housing parts relative to one another in this respect takes place by adjusting an adjustment element into a locked position. However, the lockout apparatus in accordance with the present disclosure can also be suitable for circuit breakers other than motor circuit breakers.

The two housing parts can each have a clamp jaw, in particular at their side remote from the pivot joint, the clamp jaws being moved toward one another on the transfer of the two housing parts into the clamping position in order to fixedly clamp the circuit breaker lockout apparatus to a housing of a circuit breaker, in particular of a motor circuit breaker. The two clamp jaws can each be provided with a self-adhesive friction lining or anti-slip lining to increase the effectiveness of the clamping of the lockout apparatus to a housing of a circuit breaker.

Furthermore, a locking device can be provided to fix the adjustment element in the locked position by a locking element, in particular by a padlock, in order to secure the adjustment element against an adjustment into the base position. In order to secure the housing shell at the housing of the motor circuit breaker against an unauthorized removal, a locking device can therefore be provided that, by a locking element, in particular by a padlock, fixes the adjustment element in the locked position and thereby fixes the housing shell in the clamping position and thus fixes the circuit breaker lockout apparatus at the housing of the motor circuit breaker. The unauthorized access to a handle of a motor circuit breaker can thus be prevented by the circuit breaker lockout apparatus in accordance with the present disclosure.

The adjustment element can have a drive section that engages at the two housing parts. The two housing parts can then be transferred from the release position into the clamping position by the drive section of the adjustment element.

In accordance with an embodiment, the drive section comprises a control cam that differs from a circular shape or a control cam that is oval, in particular elliptical or eccentric, in particular peripheral, and that has two mutually oppositely disposed flat regions as well as two mutually oppositely disposed end face regions. The two end face regions may be oriented in the direction of the pivot axis of the pivot joint in the base position of the adjustment element. The adjustment element may be rotatably supported by the drive section, in particular by the control cam of the drive section, in a recess that is formed in the rear wall of the housing shell and that is in particular formed in a counter-shape, with the recess being proportionally formed in the one housing part and proportionally formed in the other housing part. Due to the rotation of the adjustment element from the base position into the locked position, the two correspondingly co-rotated end face regions push the two housing parts apart at the rear wall so that the two housing parts are forced to make a pivot movement about the pivot axis of the pivot joint into the clamping position. In some embodiments, the drive section may have a respective web, in particular a peripheral web, at both sides of the control cam, with the adjustment element being held at the rear wall in the axial direction by the two webs.

The angular difference between the base position and the locked position of the adjustment element can, for example, lie in a range between 60° and 120°, in particular between 80° and 100°, in particular at 90°. The rotary movement of the adjustment element in the locked position can in particular be bounded by an abutment.

The adjustment element may comprise a manually actuable rotary handle that is in particular arranged at an outer side of the rear wall and that is at least rotationally fixedly, in particular fixedly, connected to the drive section in order to adjust the adjustment element between the base position and the locked position. The rotary handle can in this respect be configured as a wing handle that in particular has two wings projecting radially from the axis of rotation in opposite directions. Such an adjustment element is easily accessible and rotatable in a simple manner.

An abutment, in particular a respective abutment, for the rotary handle, in particular for one, in particular for a respective one, of the two wings of the wing handle can be provided on the rear wall of the housing shell at at least one of the two housing parts in the locked position of the adjustment element.

In accordance with an embodiment, the locking device can comprise that at least one of the two abutments, in particular both abutments, has, in particular have, a respective eyelet; and that one of the two wings has an eyelet, with the eyelet of the wing and the eyelet of the associated abutment being aligned with one another in the locked position so that a locking element can be led through. The other wing can generally also have an eyelet. In this way, the fixing of the adjustment element in the locked position and thus the fixing of the two housing parts in the clamping position can be achieved in a simple manner that is intuitively clear to the user.

In general, the locking device may have two eyelets that are aligned with one another in the locked position of the adjustment element so that a locking element can be led through, whereby the rotary handle of the adjustment element is fixed to the abutment. Provision may be made that, of the two eyelets, the one eyelet is formed at the rotary handle and the other eyelet is formed at the blocking element explained in the following.

In accordance with an alternative embodiment, the adjustment element can comprise a blocking element, in particular a slider. The blocking element is held at the rotary handle in a manner adjustable, in particular displaceable, in particular between a starting position and a blocking position, with the blocking element, in its blocking position, blocking an adjustment of the adjustment element located in the locked position into the base position. A rotating back of the adjustment element from the locked position, independently of a locking by a locking element, is thereby prevented in a reliable manner. A rotating back of the adjustment element could otherwise, i.e. without the blocking element, be possible under certain circumstances with a locked circuit breaker apparatus when the locking element used allows a clearance between the eyelet and the abutment.

In some embodiments, the pivot joint may comprise that the housing shell has a respective rotary connection at two mutually oppositely disposed side walls. The respective rotary connection may comprise an opening in the one housing part and a pin that is formed at the other housing part and that engages into, in particular latches into, the opening. A housing shell having such rotary connections is particularly simple to assemble from the two housing parts. The two housing parts can in particular each have an opening and a pin. Provision may be made in this respect that, for the respective rotary connection, the one housing part is formed as spring-elastic in the region of the opening and/or the other housing part is formed as spring-elastic in the region of the pin in order to enable a simple assembly of the two housing parts.

If the two housing parts are formed identically, this furthermore has an effect on the manufacturing and storage costs. In particular in this case, the two housing parts are then housing halves. The two housing parts can, however, also be formed differently from one another, in particular with different sizes.

The two housing parts can in particular each be formed as a plastic injection-molded part and/or can be formed in one piece so that the two housing parts can be manufactured particularly easily. Furthermore, more complex shapes can also be easily manufactured using an injection molding process.

The two housing parts can, for example, be pivotable relative to one other by an angle of less than 10°, in particular in a range between 2° and 8°. It is therefore sufficient if the clamping position only differs from the release position by a few angular degrees in order to achieve an effective clamping of the lockout apparatus to a housing of a circuit breaker.

In accordance with a further embodiment, provision is made that the pivot movement of the two housing parts relative to one another is bounded in the release position by an abutting of a rear wall section of the one housing part at a rear wall section of the other housing part and/or is bounded in the clamping position by an abutting of at least one side wall section of the one housing part at a respective side wall section of the other housing part.

BRIEF DESCRIPTION OF THE DRAWINGS

Further embodiments of the present disclosure are described in the dependent claims, in the description of the Figures, and in the drawing.

The present disclosure will be described in the following by way of example with reference to the drawing. There are shown FIG. 1A a motor circuit breaker and a motor circuit breaker lockout apparatus in accordance with the present disclosure in a release position.

DETAILED DESCRIPTION

Figure 1A:
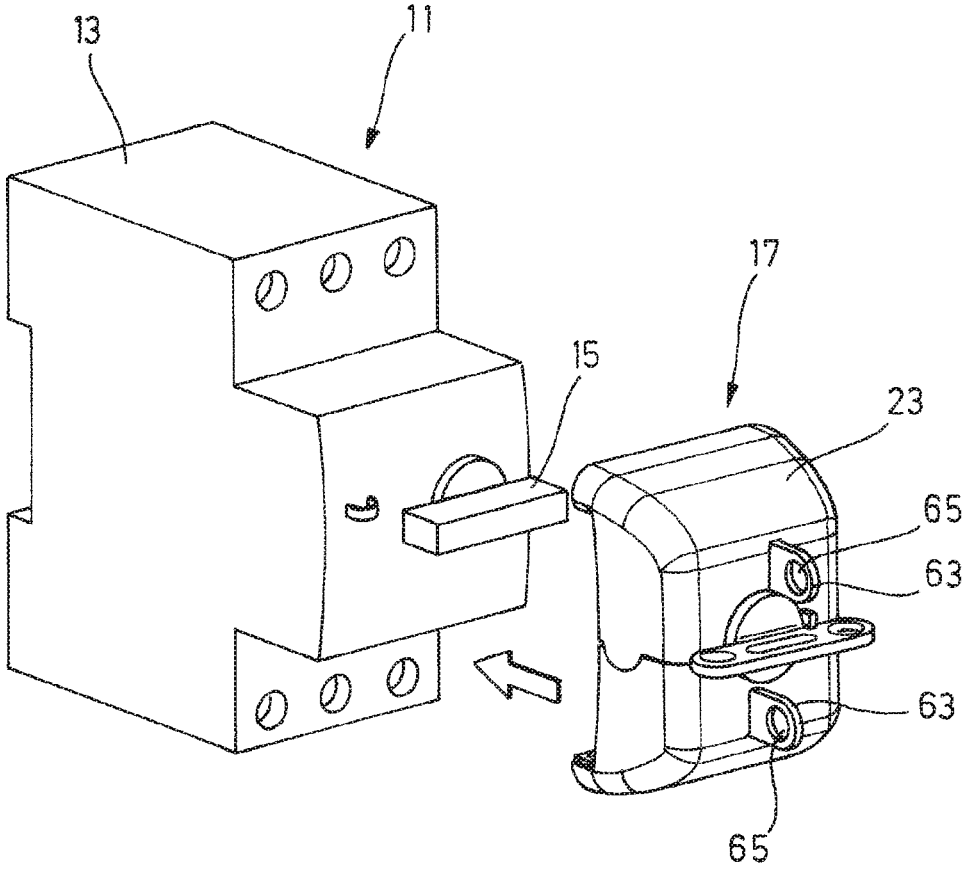
FIG. 1B the motor circuit breaker and the motor circuit breaker lockout apparatus from FIG. 1A, with the motor circuit breaker lockout apparatus adopting a clamping position which is secured by a padlock and in which it is fixedly clamped to the motor circuit breaker.
Figure 1B:
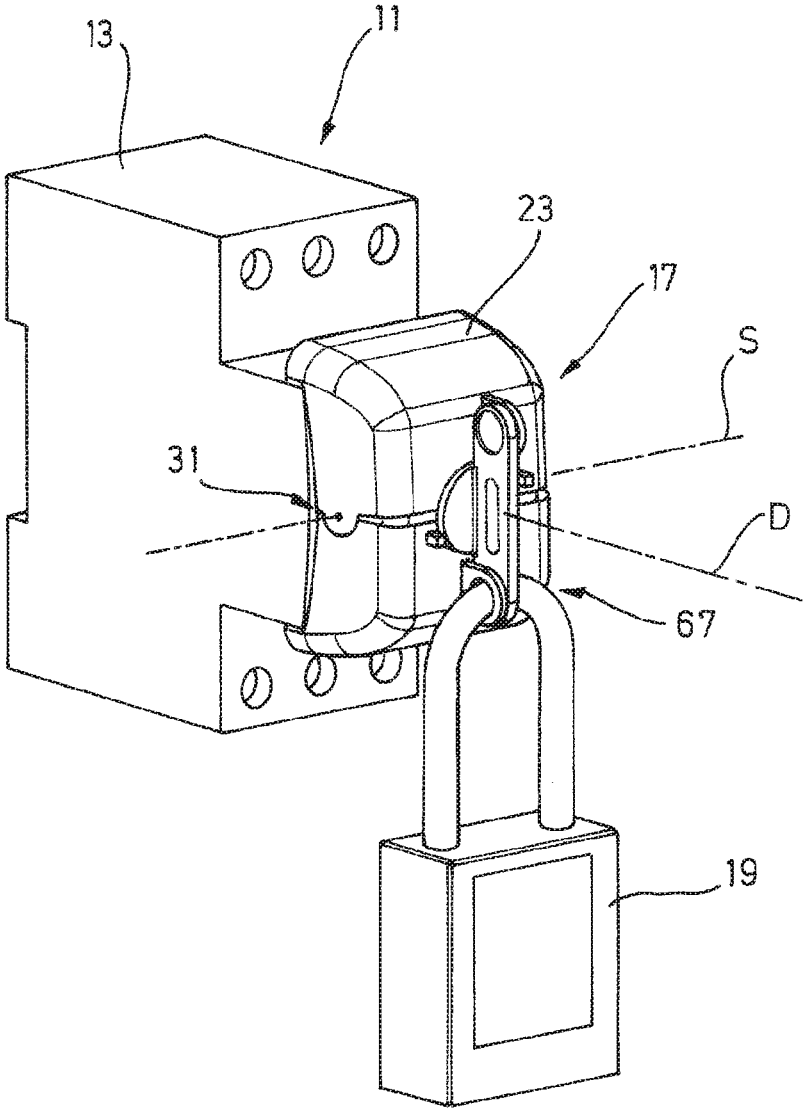

A standard motor circuit breaker 11 having a housing 13 and a rotary switch 15, which can be switched between an OFF and an ON position, is shown in FIGS. 1A and 1B. A motor circuit breaker lockout apparatus 17 can be fastened to the housing 13 of the motor circuit breaker 11 and can subsequently be secured against a removal from the housing 13 by a padlock 19 in order to prevent an actuation of the rotary switch 15 (cf. FIG. 1B). This is in particular necessary if a manual switching back on of a previously triggered motor circuit breaker 11 by any third party is to be prevented.

Figure 2:
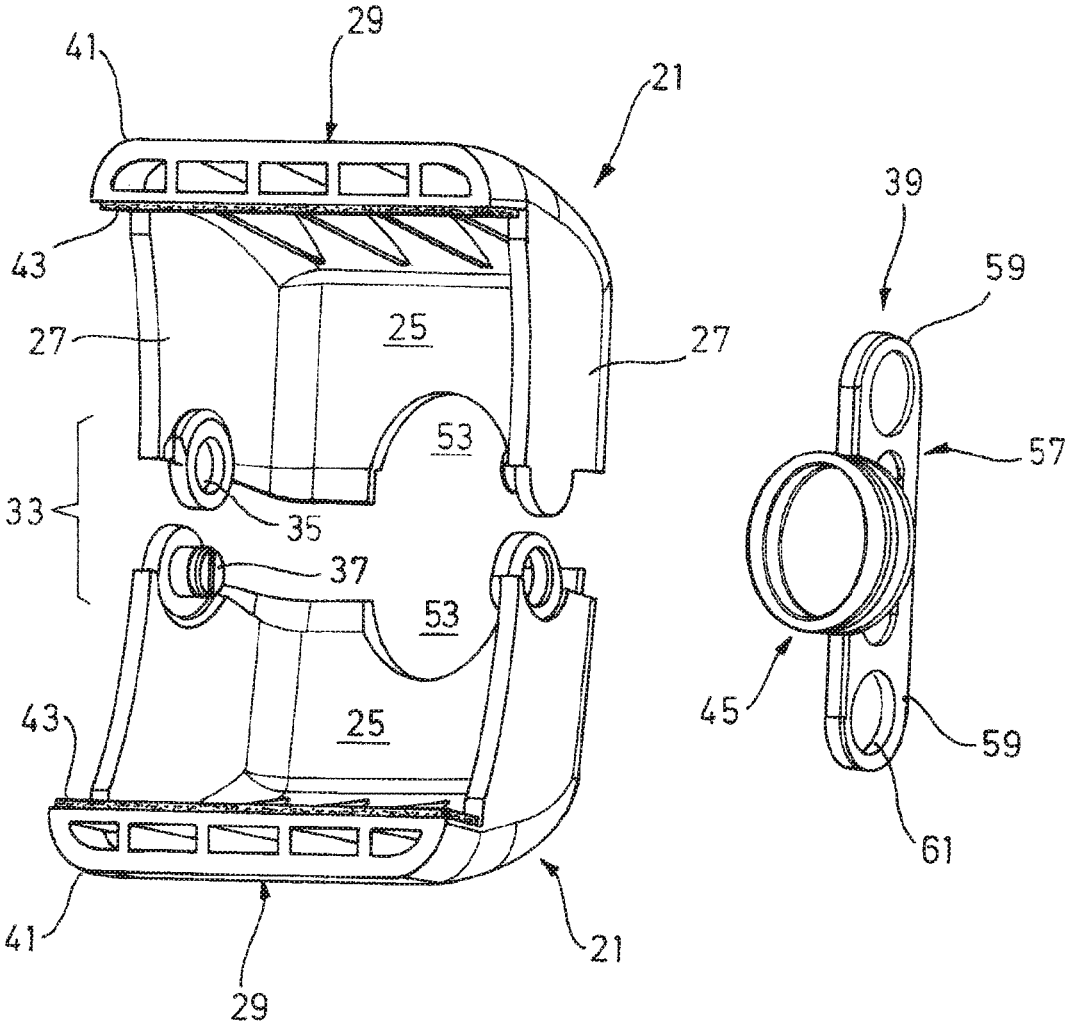
FIG. 2 the motor circuit breaker lockout apparatus from FIG. 1 in a exploded representation.

The motor circuit breaker lockout apparatus 17 comprises two half-shell like housing parts 21, in particular housing halves, that are assembled to form a housing shell 23 having a rear wall 25, two mutually oppositely disposed side walls 27, and two mutually oppositely disposed end walls 29 (cf. also FIG. 2). The two housing parts 21 are formed identically in the embodiment in accordance with FIGS. 1 to 3, but can also be formed differently, in particular with different sizes. The two housing parts 21 are each manufactured by a plastic injection molding process and are therefore formed in one piece. The two housing parts 21 each have a projecting clamp jaw 41 via which the motor circuit breaker lockout apparatus 17 can be clamped, and can thus be fastened, to the housing 13 of the motor circuit breaker 11.

The two housing parts 21 are connected to one another via a pivot joint 31. The pivot joint 31 defines a pivot axis S to pivot the two housing parts 21 relative to one another. The pivot joint 31 has a respective rotary connection 33 at the two side walls 27 of the housing shell 23. For this purpose, the two housing parts 21 respectively have an opening 35 at the one side wall 27 and a pin 37 at the other side wall 27. On the assembly of the two housing parts 21, the pin 37 of the one housing part 21 then engages into the opening 35 of the other housing part 21, and vice versa, whereby the two rotary connections 33 and thus the pivot joint 31 are formed. Since the pins 37 are configured as expanding pins, they latch into the openings 35. To enable the assembly of the two housing parts 21, the side walls 27 are formed as spring-elastic at least in the region of the openings 35 and/or of the pins 37.

The motor circuit breaker lockout apparatus 17 further comprises an adjustment element 39 that is rotatable about an axis of rotation D between a base position that is shown in FIG. 1A and a locked position that is shown in FIG. 1B. In this respect, the base position and the locked position are offset from one another by at least substantially 90°. A rotation of the adjustment element 39 from the base position into the locked position causes the two housing parts 21 to be tilted, in particular slightly tilted, with respect to one another about the pivot axis S from a release position that is shown in FIG. 1A and thereby into a clamping position that is shown in FIG. 1B, whereby the two clamp jaws 41, which are each arranged at the free end of the respective housing part 21, are moved toward one another in order to clamp the housing 13 of the motor circuit breaker 11 therebetween and thus to fasten the motor circuit breaker lockout apparatus 17 to the housing 13 of the motor circuit breaker 11. To increase the clamping effect, the two clamp jaws 41 are each provided with a strip-shaped friction lining 43 at their mutually facing sides.

The two housing parts 21 are limited to a pivotability with respect to one another by an angle of a few degrees, for example in a range between 2° and 8°. The limitation is achieved in that a rear wall section of the one housing part 21 abuts a rear wall section of the other housing part 21 in the release position and a respective side wall section of the one housing part 21 abuts a respective side wall section of the other housing part 21 in the clamping position.

Figure 3A:
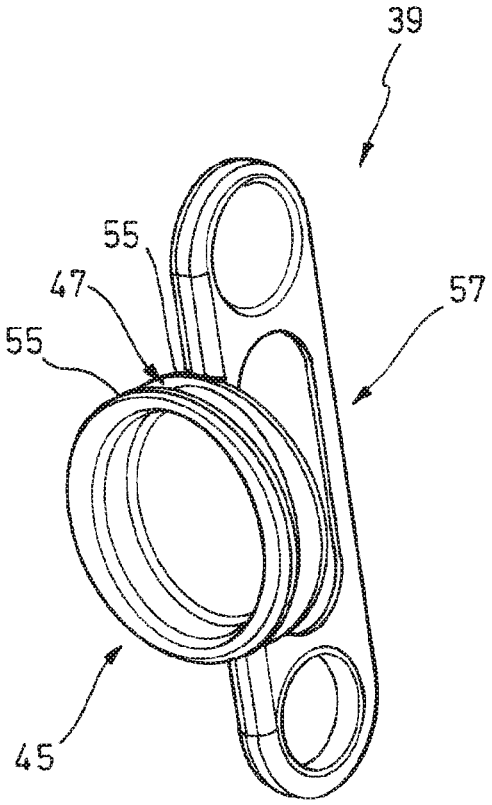
FIG. 3A an adjustment element of the motor circuit breaker lockout apparatus from FIGS. 1 and 2 in a perspective view.
Figure 3B:
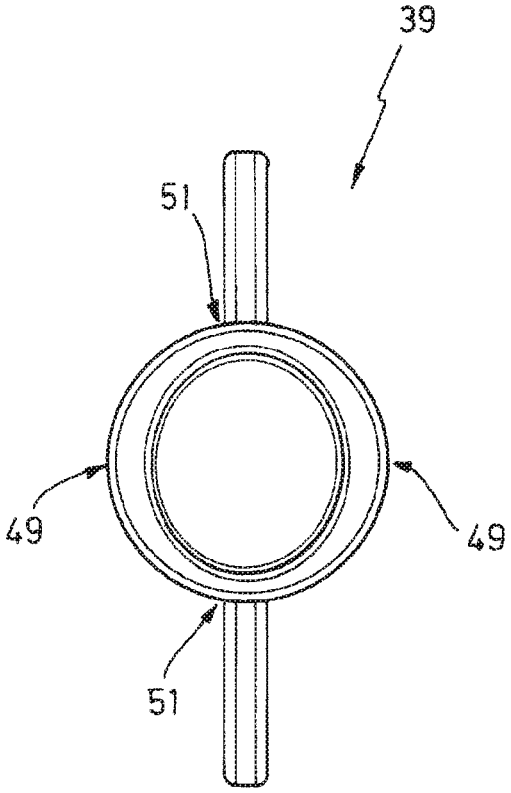
FIG. 3B the adjustment element of the motor circuit breaker lockout apparatus from FIGS. 1 and 2 in a frontal view FIG. 4A a motor circuit breaker lockout apparatus in accordance with a further embodiment of the present disclosure in a first side perspective view.

The adjustment element 39 comprises a drive section 45 having a peripheral control cam 47 that is oval, in particular eccentric, and that has two mutually oppositely disposed flat regions 49 as well as two mutually oppositely disposed end face regions 51 (cf. in particular FIGS. 3A and 3B). The adjustment element 39 is rotatably supported via the drive section 45, in particular via the control cam 47 of the drive section 45, in a recess 53 that is formed in the rear wall 25 of the housing shell 23 and that is formed in a counter-shape to the drive section 45. The recess 53 is in this respect formed half in the one housing part 21 and half in the other housing part 21.

Since the two end face regions 51 are oriented in the direction of the pivot axis S of the pivot joint 31 in the base position of the adjustment element 39, the drive section 45 engages at the two housing parts 21 such that, on a rotation of the adjustment element 39 from the base position into the locked position, the two end face regions 51 of the drive section 45 push the two housing parts 21 apart at the rear wall 25 so that the two housing parts 21 are driven into the clamping position for the aforesaid pivot movement about the pivot axis S of the pivot joint 31. To axially fixedly fasten the adjustment element 39 to the rear wall 25, a respective peripheral web 55 is provided at both sides of the control cam 47.

To effect the rotation between the base position and the locked position, the adjustment element 39 comprises a manually actuable rotary handle 57 that is fixedly connected to the drive section 45, that is arranged at an outer side of the rear wall 25 in the assembled state of the motor circuit breaker lockout apparatus 17, and that is configured as a wing handle that has two wings 59 projecting radially from the axis of rotation D in opposite directions.

To secure the motor circuit breaker lockout apparatus 17 in the clamping position in accordance with FIG. 1B against a removal from the housing 13 of the motor circuit breaker 11, one of the two wings 59 of the rotary handle 57 has an eyelet 61. Furthermore, a respective abutment 63 projects at the rear wall 25 of the housing shell 23 at the two housing parts 21, wherein the two abutments 63 are each likewise provided with an eyelet 65. In the locked position of the adjustment element 39, a respective wing 59 of the rotary handle 57 abuts a respective one of the two abutments 63, wherein the eyelet 61 of the one wing 59 is in alignment with the eyelet 65 of the abutment 63 which the wing 59 abuts with the eyelet 61 in the locked position so that a hoop of the padlock 19 can be led through the eyelet pair 61, 65 hereby formed so that the adjustment element 39 can be fixed in the locked position. The one wing 59, the eyelet 61, the one abutment 63, and the associated eyelet 65 in this respect form a locking device 67 in accordance with the present disclosure or are at least a part of it.

Figure 4A:
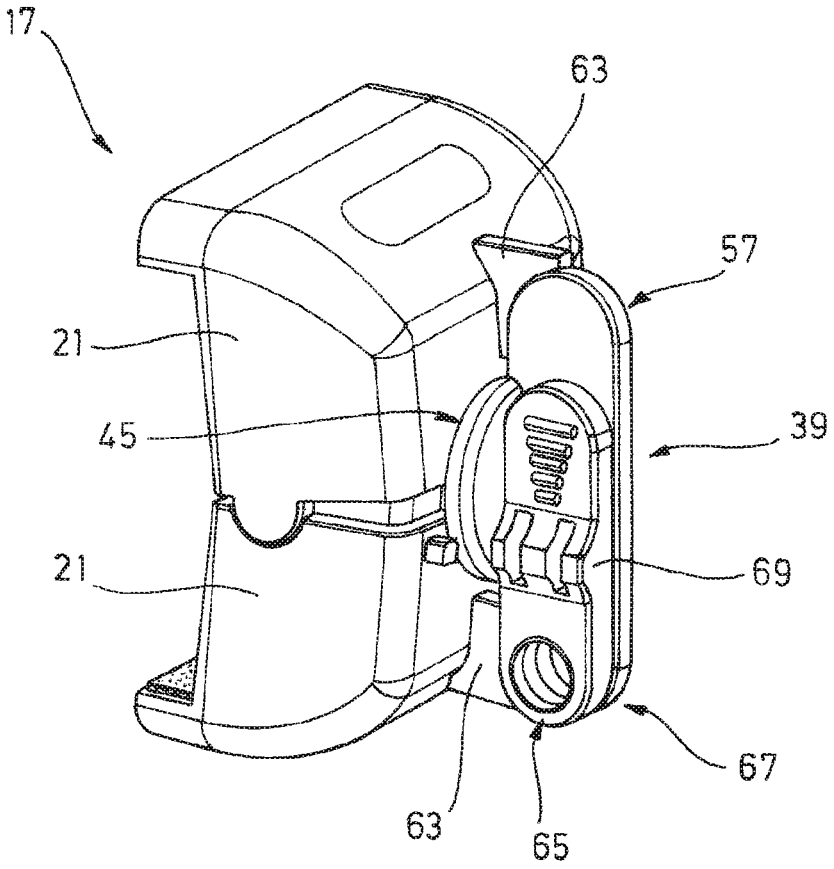
FIG. 4B the motor circuit breaker lockout apparatus in accordance with the further embodiment of the present disclosure in a second side perspective view.
Figure 4B:
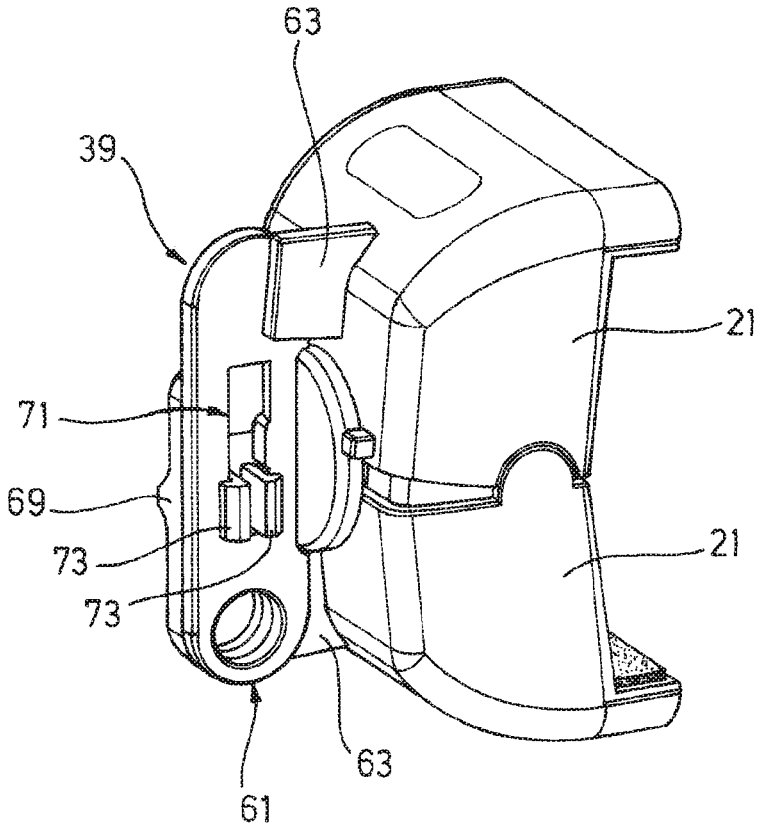
Figure 5:
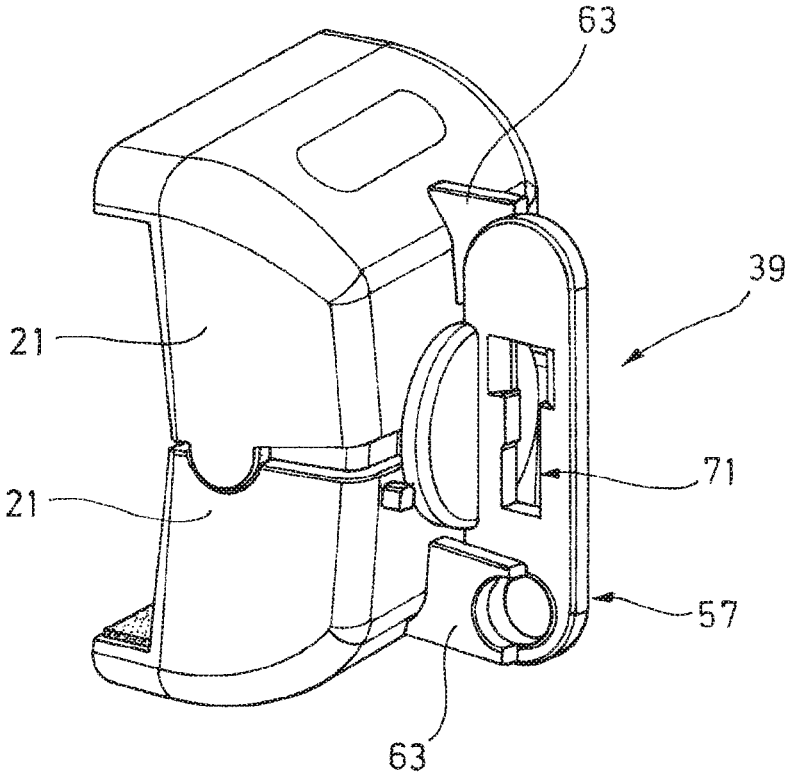
FIG. 5 the motor circuit breaker lockout apparatus in accordance with FIG. 4A, with a blocking element being omitted.

A further embodiment of a motor circuit breaker lockout apparatus 17 is shown in FIGS. 4A, 4B, and 5, wherein, in comparison with the first embodiment in accordance with FIGS. 1A to 3B, features that are the same or that have the same effect are designated by the same reference numerals, and wherein the differences from the first embodiment will primarily be looked at in the following, which differences substantially lie in the design of the adjustment element 39 and of the abutment 63 of the housing part 21 that is the lower housing part in the Figs.

The adjustment element 39 of the embodiment in accordance with FIGS. 4A, 4B, and 5 has a drive section 45 and a manually actuable rotary handle 57 connected to the drive section 45, and the rotary handle 57 comprising a wing 59 having an eyelet 61; that corresponds to the drive section 45 and to the rotary handle 57 comprising the wing 59 having the eyelet 61 of the embodiment in accordance with FIGS. 1A to 3B. In addition, the adjustment element 39 has a blocking element 69 that is inserted into a longitudinal aperture 71 formed in the rotary handle 57. For this purpose, the blocking element 69 is clipped onto the rotary handle 57 via two spring-elastic latch projections 73 that engage behind the longitudinal aperture 71. Furthermore, an eyelet 65 is formed in the blocking element 69. For this purpose, the abutment 63 of the lower housing part 21, in contrast to the embodiment in accordance with FIGS. 1A to 3B, does not have an eyelet.

The blocking element 69 is displaceable along the longitudinal extent of the longitudinal aperture 71 between a starting position, not shown, and a blocking position, shown in FIG. 4B. In the starting position, the blocking element 69 is displaced upwardly with respect to the blocking position shown so that the adjustment element 39 can be easily rotated back from its locked position shown in FIGS. 4A, 4B, and 5 into the base position. If the blocking element 69 is in contrast located in its blocking position in accordance with FIG. 4A, a rotating back of the adjustment element 39 from the locked position in the direction of the base position is prevented by the blocking element 69.

Furthermore, in the blocking position of the blocking element 69, the eyelet 65 of the blocking element 69 is aligned with the eyelet 61 of the rotary handle 57 so that the padlock 19 can be led through the eyelet pair 61, 65 hereby formed, analogously to the above-explained eyelet pair of the embodiment in accordance with FIGS. 1A to 3B, in order to fix the adjustment element 39 in the locked position. The wing 59, the eyelet 61, the abutment 63, and the eyelet 65 in this respect again form a locking device 67 in accordance with the present disclosure or are at least a part of it.

REFERENCE NUMERAL LIST

11 motor circuit breaker
13 housing
15 rotary switch
17 motor circuit breaker lockout apparatus
19 padlock
21 housing part
23 housing shell
25 rear wall
27 side wall
29 end wall
31 pivot joint
33 rotary connection
35 opening
37 pin
39 adjustment element
41 clamp jaw
43 friction lining
45 drive section
47 control cam
49 flat region
51 end face region
53 recess
55 web
57 rotary handle
59 wing
61 eyelet
63 abutment
65 eyelet
67 locking device
69 blocking element
71 longitudinal aperture
73 latch projection
D axis of rotation
S pivot axis

The invention claimed is:

1. A circuit breaker lockout apparatus comprising two housing parts that are assembled to form a housing shell having a rear wall and that are connected to one another via a pivot joint that defines a pivot axis about which the two housing parts are pivotable relative to one another between a release position and a clamping position; and an adjustment element that is adjustable between a base position and a locked position in order to transfer the two housing parts from the release position into the clamping position, the adjustment element includes a drive section and a manually actuable rotary handle, the drive section engages at the two housing parts and the manually actuable rotary handle is at least rotationally fixedly connected to the drive section in order to adjust the adjustment element between the base position and the locked position.

2. The circuit breaker lockout apparatus in accordance with claim 1, wherein the two housing parts each have a clamp jaw, each clamp jaw being moved toward one another on the transfer of the two housing parts into the clamping position in order to fixedly clamp the circuit breaker lockout apparatus to a housing of a circuit breaker.

3. The circuit breaker lockout apparatus in accordance with claim 1, wherein a locking device is provided to fix the adjustment element in the locked position by a locking element in order to secure the adjustment element against an adjustment into the base position.

4. The circuit breaker lockout apparatus in accordance with claim 1, wherein the drive section comprises a control cam that differs from a circular shape and that has two mutually oppositely disposed flat regions as well as two mutually oppositely disposed end face regions.

5. The circuit breaker lockout apparatus in accordance with claim 4, wherein the drive section has a respective web at both sides of the control cam, with the adjustment element being held at the rear wall in an axial direction by each web.

6. The circuit breaker lockout apparatus in accordance with claim 4, with the two end face regions being oriented in a direction of the pivot axis of the pivot joint in the base position of the adjustment element, with the adjustment element being rotatably supported by the drive section in a recess that is formed in the rear wall of the housing shell and with the recess being proportionally formed in one housing part and proportionally formed in the other housing part.

7. The circuit breaker lockout apparatus in accordance with claim 1, wherein an angular difference between the base position and the locked position of the adjustment element is within a range between 60° and 120°.

8. The circuit breaker lockout apparatus in accordance with claim 1, wherein the rotary handle is configured as a wing handle.

9. The circuit breaker lockout apparatus in accordance with claim 1, wherein an abutment for the rotary handle is provided on the rear wall of the housing shell at least one of the two housing parts in the locked position of the adjustment element.

10. The circuit breaker lockout apparatus in accordance with claim 9, wherein a locking device is provided to fix the adjustment element in the locked position by a locking element in order to secure the adjustment element against an adjustment into the base position, with the locking device having two eyelets that are aligned with one another in the locked position of the adjustment element so that a locking element can be led through, whereby the rotary handle of the adjustment element is fixed to the abutment.

11. The circuit breaker lockout apparatus in accordance with claim 10, wherein the adjustment element comprises a blocking element with the blocking element being adjustably held at the rotary handle in a manner adjustable between a starting position and a blocking position, with the blocking element, in the blocking position, blocking an adjustment of the adjustment element located in the locked position into the base position, with, of the two eyelets, one eyelet being formed at the rotary handle and the other eyelet being formed at the blocking element.

12. The circuit breaker lockout apparatus in accordance with claim 1, wherein the adjustment element comprises a blocking element with the blocking element being adjustably held at the rotary handle in a manner adjustable between a starting position and a blocking position, with the blocking element, in the blocking position, blocking an adjustment of the adjustment element located in the locked position into the base position.

13. The circuit breaker lockout apparatus in accordance with claim 1, wherein the pivot joint comprises that the housing shell has a respective rotary connection at two mutually oppositely disposed side walls.

14. The circuit breaker lockout apparatus in accordance with claim 13, with the respective rotary connection comprising an opening in one housing part and a pin that is formed at the other housing part and that engages into the opening.

15. The circuit breaker lockout apparatus in accordance with claim 14, wherein, for the respective rotary connection, the one housing part is formed as spring-elastic in the region of the opening and/or the other housing part is formed as spring-elastic in a region of the pin in order to enable an assembly of the two housing parts.

16. The circuit breaker lockout apparatus in accordance with claim 1, wherein the two housing parts are formed at least one of identically and as a plastic injection-molded part.

17. The circuit breaker lockout apparatus in accordance with claim 1, wherein the two housing parts are pivotable relative to one other by an angle of less than 10°.

18. The circuit breaker lockout apparatus in accordance with claim 1, wherein pivotable movement of the two housing parts relative to one another is bounded in the release position by an abutting of a rear wall section of one housing part at a rear wall section of the other housing part and/or is bounded in the clamping position by an abutting of at least one side wall section of the one housing part at a respective side wall section of the other housing part.

19. A circuit breaker lockout apparatus comprising two housing parts that are assembled to form a housing shell having a rear wall and that are connected to one another via a pivot joint that defines a pivot axis about which the two housing parts are pivotable relative to one another between a release position and a clamping position; and an adjustment element that is adjustable between a base position and a locked position in order to transfer the two housing parts from the release position into the clamping position, wherein the adjustment element has a drive section that engages at the two housing parts, wherein the drive section comprises a control cam that differs from a circular shape and that has two mutually oppositely disposed flat regions as well as two mutually oppositely disposed end face regions, and wherein the drive section has a respective web at both sides of the control cam, with the adjustment element being held at the rear wall in an axial direction by each web.

20. A circuit breaker lockout apparatus comprising two housing parts that are assembled to form a housing shell having a rear wall and that are connected to one another via a pivot joint that defines a pivot axis about which the two housing parts are pivotable relative to one another between a release position and a clamping position; and an adjustment element that is adjustable between a base position and a locked position in order to transfer the two housing parts from the release position into the clamping position, wherein the adjustment element has a drive section that engages at the two housing parts, wherein the drive section comprises a control cam that differs from a circular shape and that has two mutually oppositely disposed flat regions as well as two mutually oppositely disposed end face regions, and wherein with the two end face regions being oriented in a direction of the pivot axis of the pivot joint in the base position of the adjustment element, with the adjustment element being rotatably supported by the drive section in a recess that is formed in the rear wall of the housing shell and with the recess being proportionally formed in one housing part and proportionally formed in the other housing part.

* * * * *